US009653842B2

(12) United States Patent
Savage et al.

(10) Patent No.: US 9,653,842 B2
(45) Date of Patent: May 16, 2017

(54) WATER RESISTANT USB CONNECTION SYSTEM FOR VEHICLES

(71) Applicant: Textron, Inc., Providence, RI (US)

(72) Inventors: Zachary Ronald Savage, Grovetown, GA (US); John Ledden, Augusta, GA (US); Arthur James Harvey, Beech Island, SC (US); John Frederick Criss, Jr., North Augusta, SC (US)

(73) Assignee: Textron Inc., Providence, RI (US)

( * ) Notice: Subject to any disclaimer, the term of this patent is extended or adjusted under 35 U.S.C. 154(b) by 0 days.

(21) Appl. No.: 14/703,296

(22) Filed: May 4, 2015

(65) Prior Publication Data

US 2015/0325946 A1 Nov. 12, 2015

Related U.S. Application Data

(60) Provisional application No. 61/991,022, filed on May 9, 2014.

(51) Int. Cl.
*H01R 13/52* (2006.01)
*H01R 12/70* (2011.01)
*H01R 13/447* (2006.01)

(52) U.S. Cl.
CPC ..... *H01R 13/5227* (2013.01); *H01R 12/7076* (2013.01); *H01R 13/447* (2013.01); *H01R 13/5213* (2013.01)

(58) Field of Classification Search
CPC ..... H01R 13/447; H01R 13/4532; H01R 13/5202; H01R 13/5213; H01R 12/7076
USPC ..... 439/142, 143, 206, 136
See application file for complete search history.

(56) References Cited

U.S. PATENT DOCUMENTS 4,093,331 A * 6/1978 Molchan ..... H01R 13/5213 439/144
5,458,496 A * 10/1995 Itou ..... B60L 11/1846 439/34
8,323,050 B2 * 12/2012 Stantchev ..... H01R 13/6395 439/34
2004/0106313 A1 * 6/2004 Drane ..... H01R 13/506 439/142
2013/0284484 A1 * 10/2013 Toyama ..... B32B 1/00 174/68.3

(Continued)

*Primary Examiner* — James Harvey
*Assistant Examiner* — Oscar C Jimenez
(74) *Attorney, Agent, or Firm* — Polster Lieder

(57) ABSTRACT

The present disclosure provides a USB connection system for an open cab vehicle such as a golf car, turf-care vehicle, small maintenance vehicle, shuttle vehicle, cargo vehicle, all-terrain vehicle, utility terrain vehicle, motorcycle, and/or other utility vehicle, and/or other outdoor/off-road vehicle. The USB connection system comprises a module structured and operable to receive and retain at least one USB port, a water protected circuit board located remotely from the USB port(s) and electrically and communicatively connected to the USB port(s). The USB connection system additionally comprises a laterally rotatable slide-away cover that is pivotally connected to the module via a pivot pin longitudinally disposed within a module housing such that the cover can be laterally rotated, between an opened and a closed position about the pivot pin. Furthermore, in various implementations, the module includes at least one water drainage channel structured and operable to drain water away from the USB port(s).

14 Claims, 9 Drawing Sheets

(56) References Cited

U.S. PATENT DOCUMENTS

2014/0273650 A1* 9/2014 Reeves ..... H01R 13/648
439/660
2014/0328076 A1* 11/2014 Firman, II ..... H01R 13/6675
362/511

* cited by examiner

WATER RESISTANT USB CONNECTION SYSTEM FOR VEHICLES

CROSS-REFERENCE TO RELATED APPLICATIONS

This application claims the benefit of U.S. Provisional Application No. 61/991,022, filed on May 9, 2014. The disclosure of the above application is incorporated herein by reference in its entirety.

FIELD

The present teachings relate to utility vehicles, e.g., golf cars, turf-care vehicles, small maintenance, shuttle or cargo vehicles, etc., and more particularly to a water resistant universal serial bus (USB) connection system for such vehicles.

BACKGROUND

The statements in this section merely provide background information related to the present disclosure and may not constitute prior art.

In light of contemporary technology and the need for instant information access and connectivity, it has become important that users of utility vehicles, such as golf cars, turf-care vehicles, and small maintenance, shuttle or cargo vehicles, (e.g., golfers, golf course superintendents, maintenance crews of golf courses, sporting venues, parks, consumer lawns, etc.) be able to charge and use their electronic devices, e.g., phones, tablets, laptops, range finders and other accessories, while using and operating such vehicles. Currently, universal serial bus (USB) connections are commonly used to provide information connectivity and/or for charging such devices. However, USB ports that provide such USB connections are not typically provided in environments that are readily exposed to weather, water and harsh environmental conditions. That is, such known USB ports are not typically protected from water, rain, moisture, dirt and other debris while in use in the respective outdoor environment and during maintenance and cleaning or washing of the respective vehicle. In the rare instances where USB ports are provided in such environments, a door or cap is typically utilized to cover the ports when not in use. However, such protective doors/caps are typically manually removed and replaced, or designed to open and close via a swing-away biased hinge, in a typical swing-away door-like or clam shell-like manner, i.e., in a swing-away manner in which a typical passage door in a home opens and closes. With such known doors/caps it is common for operators to not replace/close the doors/caps. Additionally, in the cased of biased doors/caps, when the door/cap is opened and the device USB connector is plugged into the USB port, the biased door/cap places unwanted forces on the wires of the USB connector and the USB port that can damage the connector and/or port.

SUMMARY

The present disclosure provides a USB connection system for an open cab vehicle such as a golf car, a turf-care vehicle, a small maintenance vehicle, a shuttle vehicle, a cargo vehicle, an all-terrain vehicle (ATV), a utility terrain vehicle (UTV), a motorcycle and/or any other utility vehicle, and/or any other outdoor/off-road vehicle. In various, embodiments, the USB connection system comprises a housing structured and operable to receive and retain at least one USB port, a water protected circuit board located remotely from the USB port(s) and electrically and communicatively connected to the USB port(s). The USB connection system additionally comprises a laterally rotatable slide-away cover that is pivotally connected to the housing via a pivot pin longitudinally disposed within the housing such that the cover can be laterally rotated, between an opened and closed position about the pivot pin. Furthermore, in various implementations, the housing includes at least one water drainage channel structured and operable to drain water away from the USB port(s).

Further areas of applicability of the present teachings will become apparent from the description provided herein. It should be understood that the description and specific examples are intended for purposes of illustration only and are not intended to limit the scope of the present teachings.

DRAWINGS

The drawings described herein are for illustration purposes only and are not intended to limit the scope of the present teachings in any way.

Corresponding reference numerals indicate corresponding parts throughout the several views of drawings.

DETAILED DESCRIPTION

Figure 1:
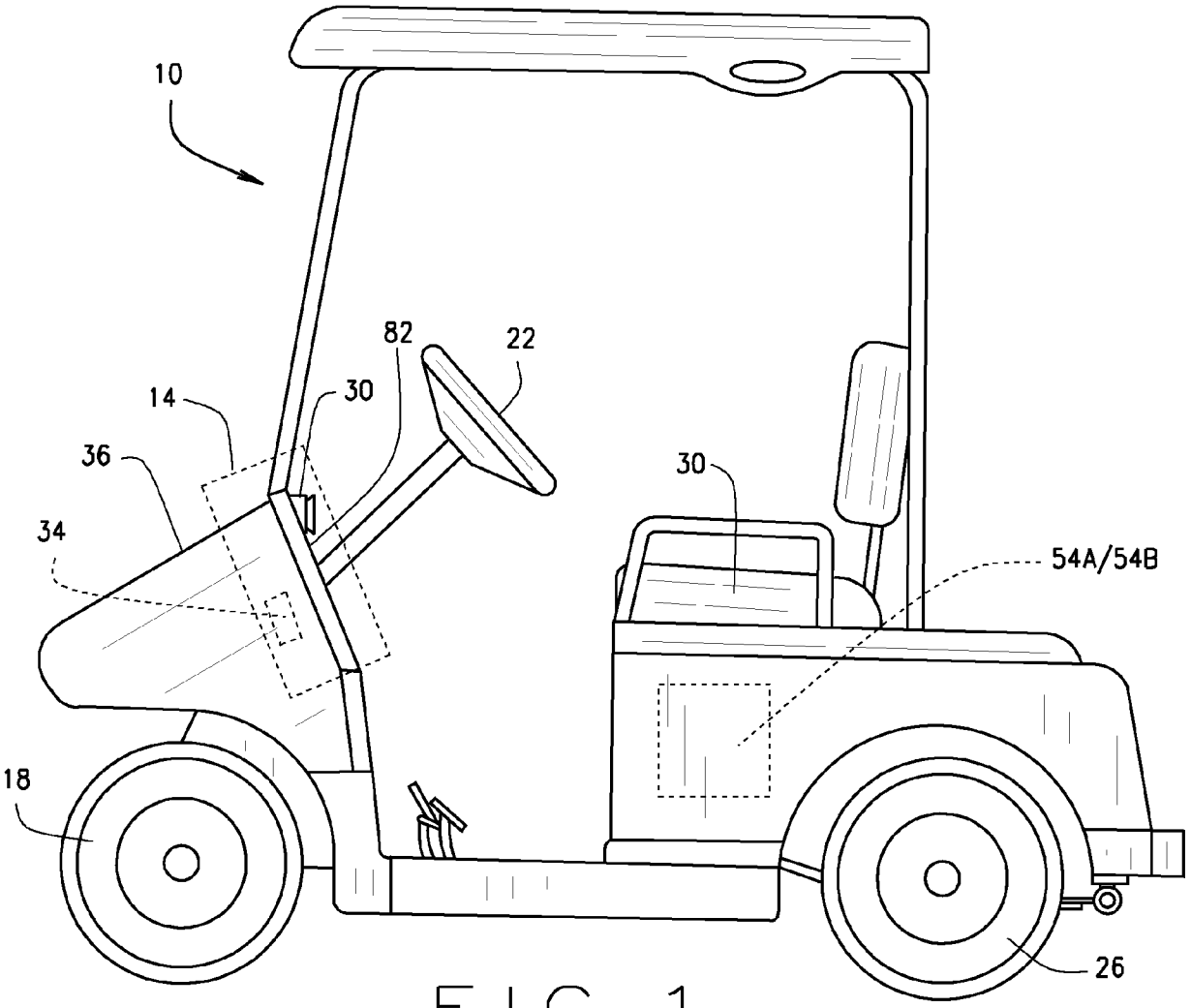
FIG. 1 is a side view of an open cab vehicle including a water resistant USB connection system, in accordance with various embodiments of the present disclosure.

The following description is merely exemplary in nature and is in no way intended to limit the present teachings, application, or uses. Throughout this specification, like reference numerals will be used to refer to like elements.

FIG. 1 depicts an open cab vehicle 10, such as a golf car, a turf-care vehicle, a small maintenance vehicle, a shuttle vehicle, a cargo vehicle, an all-terrain vehicle (ATV), a utility terrain vehicle (UTV), a motorcycle and/or any other utility vehicle, and/or any other outdoor/off-road vehicle, having a water resistant universal serial bus (USB) system 14 in accordance with the various embodiments. Generally, the vehicle 10 comprises a pair of front wheels 18 operably connected to a steering wheel 22 for steering the vehicle 10, and a pair of rear wheels 26, at least one of which is operably connected to a prime mover (e.g., an internal combustion engine or electric motor) (not shown) and drivetrain (not shown) for providing motive force to the vehicle 10. Additionally, the vehicle 10 generally includes at least one seat 30 for accommodating a driver and/or a passenger, e.g., a single bench seat or a pair of side-by-side seats.

Referring to FIGS. 1, 2, 3 and 7, in various embodiments the system 14 includes a USB connector assembly 30 (shown in FIGS. 2 and 3) and a water protected, e.g., water resistant or waterproof, circuit board assembly 34 (e.g., a printed circuit board (PCB) assembly) (shown in FIG. 7) to which the USB connector assembly 30 is removably connectable. Importantly, the circuit board assembly 34 is located remotely from a USB port module 70 of the USB connector assembly 30 (described below) such that any moisture sensitive electronics of the circuit board assembly 34 are physically separated from any water or moisture that may enter the USB port module 70, which is exposed to external elements, e.g., water, rain, dirt, dust, moisture and other environmental debris. For example, in various embodiments, the circuit board assembly 34 can be mounted under a cowl 36 of the vehicle 10, a significant distance (e.g., 4 inches to 3 feet, or greater) away from the USB port module mounted to a dashboard panel 82 (shown in FIG. 4) of the vehicle and exposed to the outdoor environment.

Figure 7:
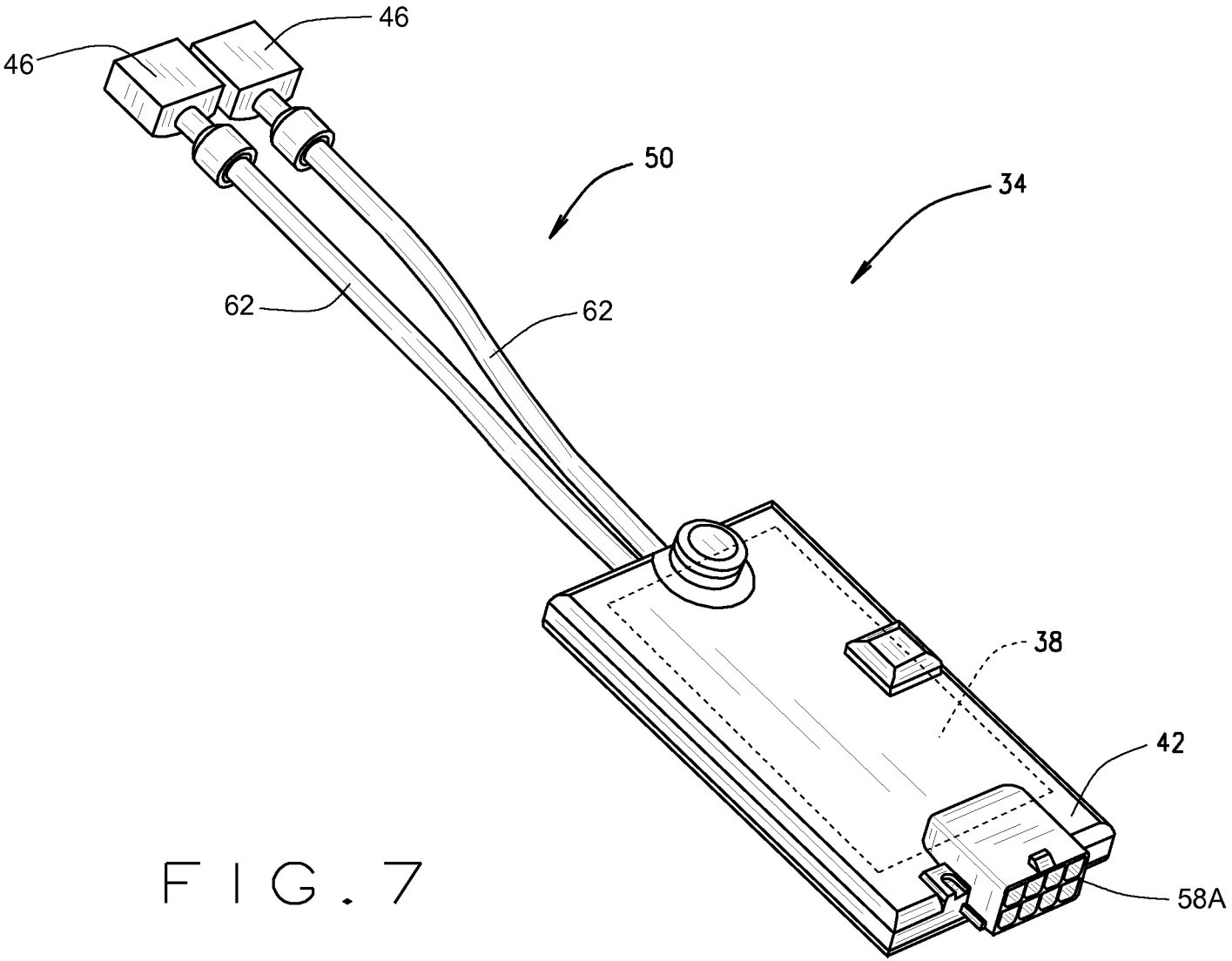
FIG. 7 is an isometric view of a water protected power converter and communication circuit of the USB connection system shown in FIG. 1, in accordance with various embodiments of the present disclosure.

Referring particularly to FIG. 7, generally, the circuit board assembly 34 comprises a power converter and communication circuit 38, e.g., a power converter and communication printed circuit board (PCB). As described below, the power converter and communication circuit 38 comprises a regulated USB power supply circuit 40 (shown in FIG. 8A) that can receive a wide range of input voltages, e.g., 5 volts to 100 volts, and output a regulated voltage, e.g., 5 volts, that can be utilized by a user device, e.g., a phone, tablet, laptop, range finder or other portable electronic device, (not shown) when such a device is connected to the USB connector assembly 30. In various embodiments, the water protected power converter and communication circuit 38 can be encapsulated within a water protective housing or coating 42, e.g., water resistant or waterproof housing or coating. For example, in various implementations, the power converter and communication circuit 38 can be encapsulated within a thermoplastic material.

The circuit board assembly 34 additionally includes a power supply and vehicle communication harness 50 that is connected to the power converter and communication circuit 38 at a proximal end and connectable to a main electrical and communication harness (not shown) of the vehicle 10 at a distal end. Particularly, the power supply and vehicle communication harness 50 is structured and operable to convey power (e.g., 5 to 48 volts) from a vehicle onboard power source or supply, and bidirectional communication signals from various vehicle systems and devices, to the power converter and communication circuit 38. For example, in various embodiments, the power supply and vehicle communication harness 50 includes at least one harness cable 62, wherein each harness cable 62 is connected to the power converter and communication circuit 38 at a proximal end, and is connectable to the vehicle main electrical and communication harness via a vehicle power supply and communication connector 46 disposed at a distal end. Via the connection to the vehicle main electrical and communication harness, the power converter and communication circuit 38 is electrically connected to the vehicle onboard power source or supply, i.e., a 12 to 48 volt battery 54A or battery pack 54B (i.e., a plurality of electrically connected batteries) of the vehicle 10 (shown in FIGS. 1 and 8B). Importantly, in various embodiments, the circuit board assembly 34, i.e., the power converter and communication circuit 38, is designed to accept input voltages ranging from 5 volts to 100 volts without damaging the power converter and communication circuit 38 or a user device connected to the USB system 14.

The circuit board assembly 34 further includes at least one first USB harness connector 58A that is connectable to a respective second USB harness connector 58B of the USB connector assembly 30. The first and second USB harness connectors 58A and 58B are structured and operable (via removable connection therebetween) to: 1) supply power, e.g., 5 volts, from the power converter and communication circuit 38 to a user device, e.g., a phone, tablet, laptop, range finder or other portable electronic device (not shown); and 2) convey bidirectional communication signals (i.e. data input/output signals) between the power converter and communication circuit 38 and the user device when such a device is connected to the USB connector assembly 30, via the USB port module 70, as described below. In various embodiments, the bidirectional input/output communication signals between the user device and the power converter and communication circuit 38 can be of any desired data protocol suitable for enabling Internet connection of the user device and/or the power converter and communication circuit 38 (e.g., WiFi or LAN or WAN connection), and to enable control and configuration data dumps or uploads between the user device, the power converter and communication circuit 38 and other systems of the vehicle 10.

Figure 2:
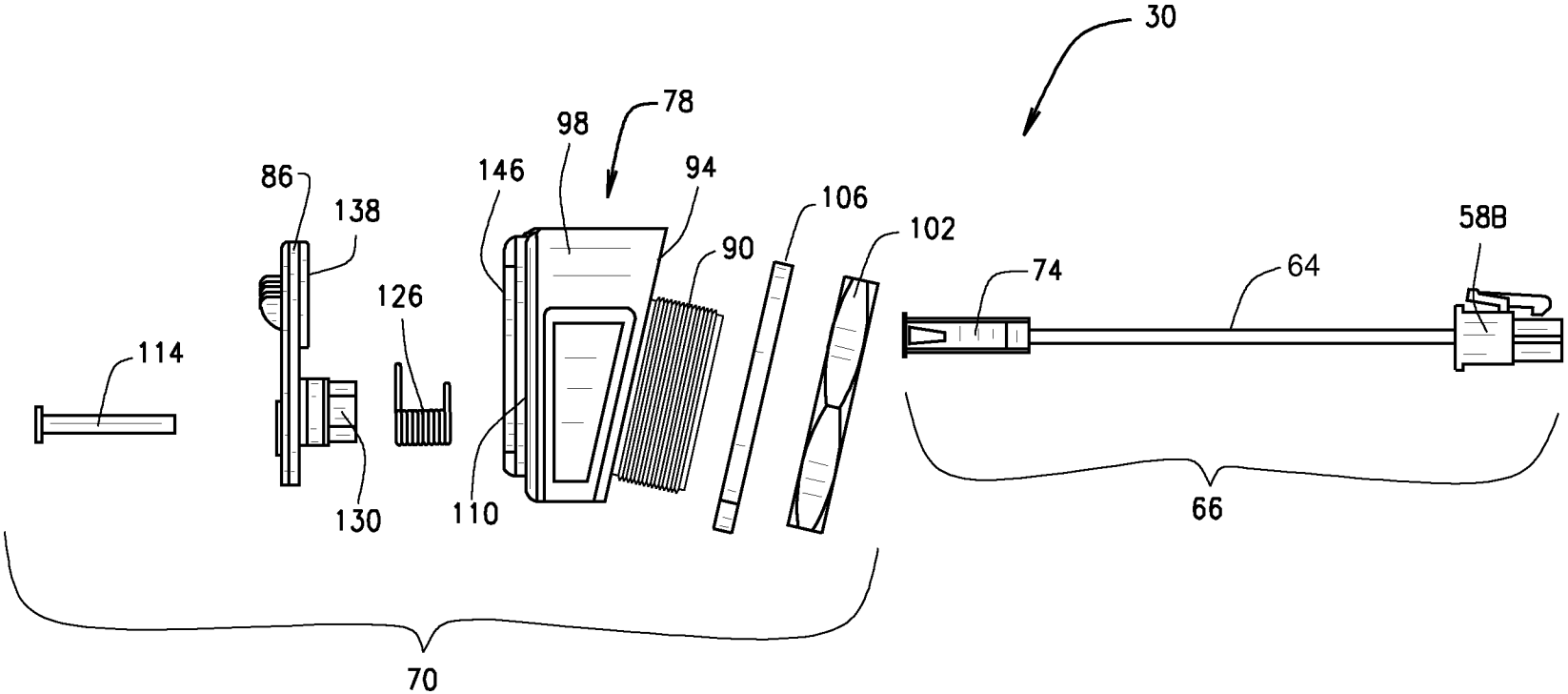
FIG. 2 is an exploded side view of a connector assembly of the water resistant USB connection system shown in FIG. 1 including a USB port module having a laterally rotatable slide-away protective cover in a Closed position covering a face of a housing and at least one USB port disposed within the housing, in accordance with various embodiments of the present disclosure.
Figure 3:
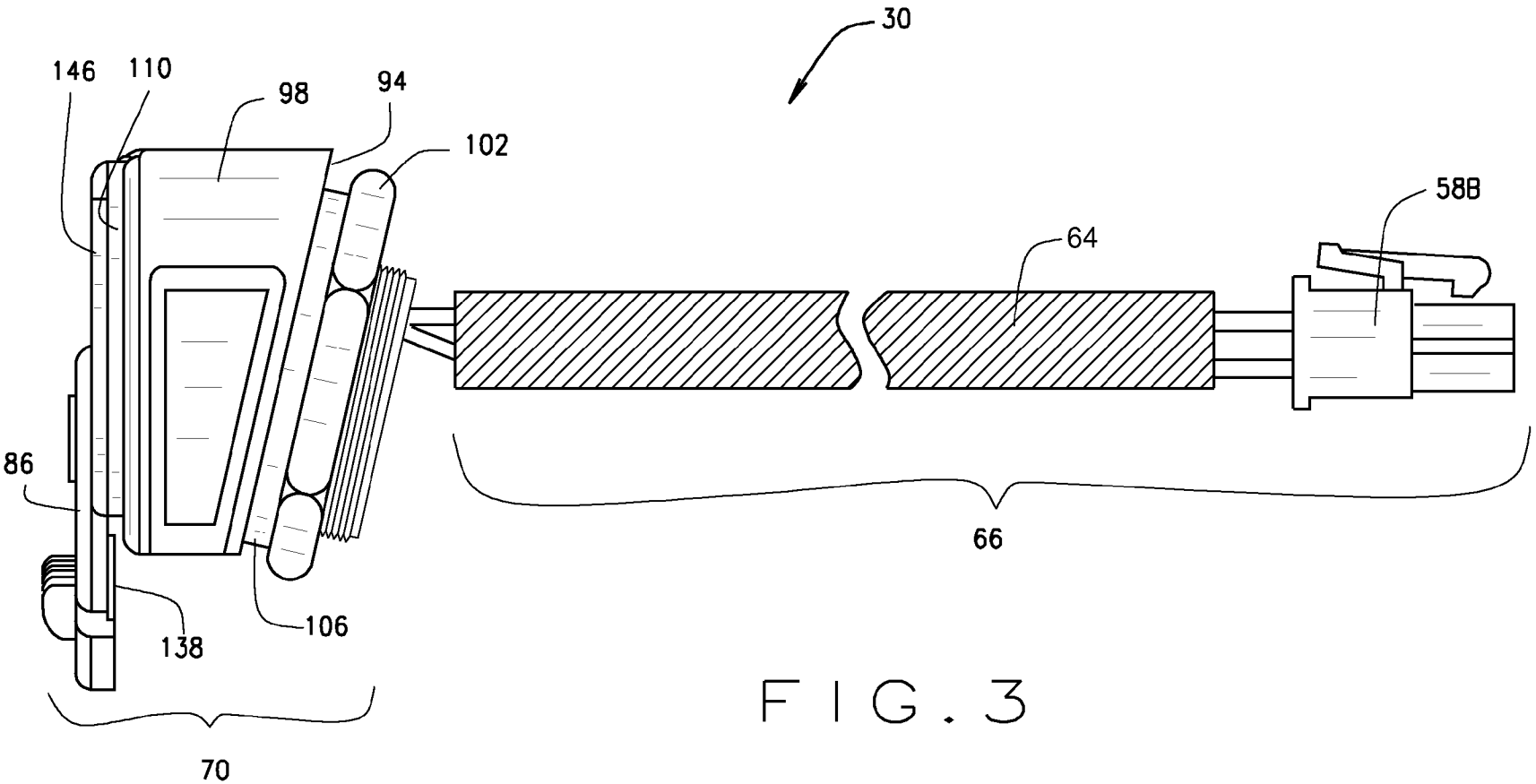
FIG. 3 is an assembled side view of the connector assembly shown in FIG. 2 having the laterally rotatable slide-away protective cover in an Open position exposing the face of the housing and allowing access the USB port(s) for connection of at least one device cable USB connector thereto, in accordance with various embodiments to the present disclosure.
Figure 4:
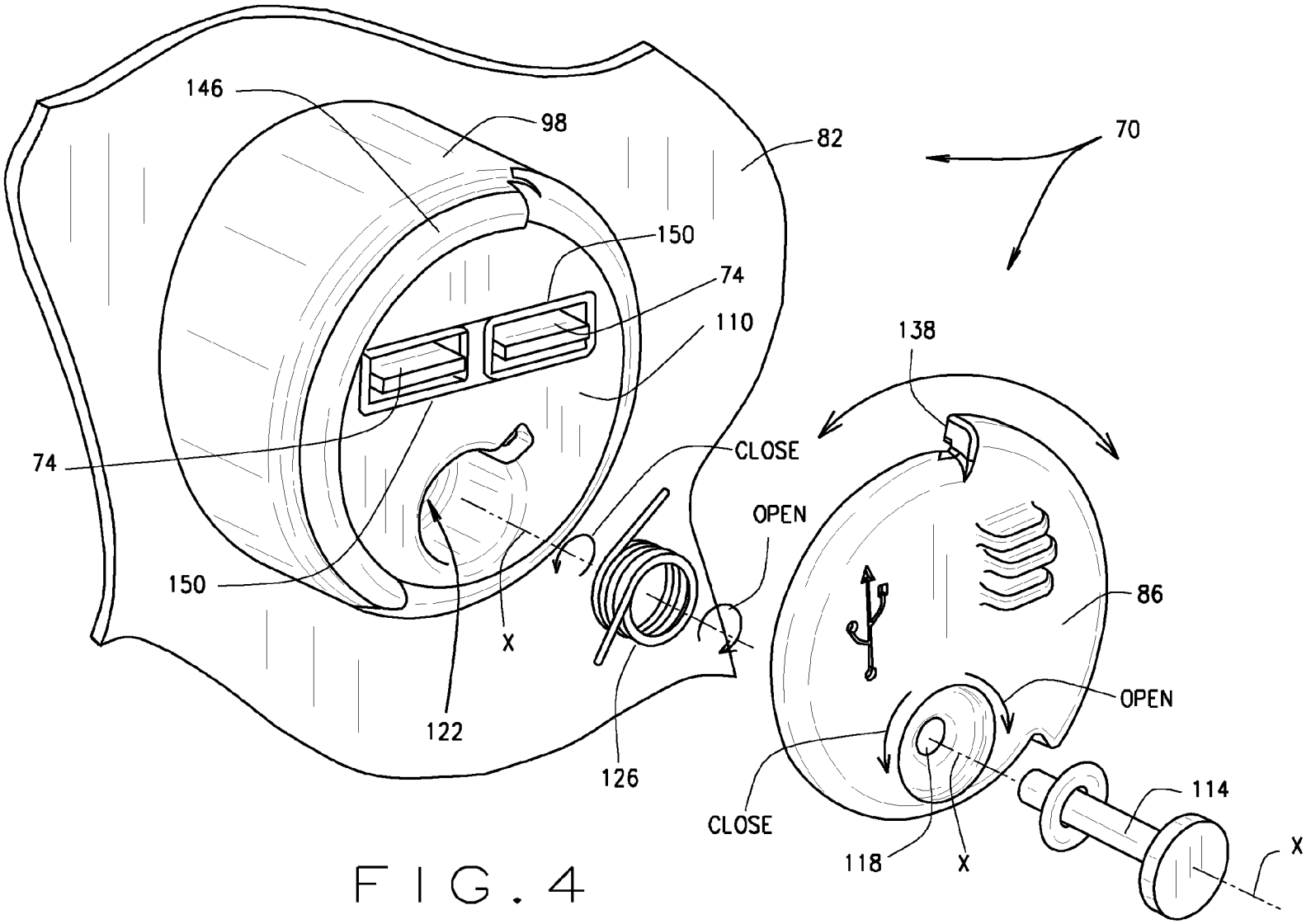
FIG. 4 is an isometric exploded view of the USB port module shown in FIGS. 1, 2 and 3, in accordance with various embodiments of the present disclosure.

Referring particularly to FIGS. 2, 3 and 4, the USB connector assembly 30 generally comprises a USB port module 70 and the USB connection harness 66 that is connectable to the USB port module 70. In various embodiments, the USB connection harness 66 includes at least one USB power and communication cable 64. Each power and communication cable 64 having a second USB harness connector 58B disposed at a proximal end and a USB port 74, e.g., a female USB port, disposed at an opposing distal end. As described above, each second USB harness connector 58B is removably connectable to a respective first USB harness connector 58A to electrically and communicatively connect each respective USB port 74 to the power converter and communication circuit 38.

The USB port module 70 generally comprises a USB port housing or body 78 that is removably mountable to the front panel 82 of a dashboard of the vehicle 10. The USB port module 70 additionally comprises a laterally rotatable slide-away protective cover 86 that is pivotally connected to the housing 78 such that the cover 86 can be bidirectionally laterally rotated in a clockwise and a counter-clockwise direction, relative to a front face 110 of a housing head 98 of the USB port housing 78, between an opened position (shown in FIG. 3) and a closed position (shown in FIG. 2). The housing 78 can be mountable to the dashboard panel 82 via any suitable connection means, e.g., bolted, riveted, screwed, glued, etc., to the dashboard panel 82. For example, in various embodiments, as exemplarily illustrated in FIGS. 2 and 3, the housing 78 can include a threaded neck 90 extending from a back face 94 of a head 98 of housing 78. In such instances, the threaded neck 90 is sized to extend through a hole (not shown) in the dashboard panel 82, whereafter a threaded nut 102, and optionally a washer 106, can be placed over (in the case of the washer 106) and threaded onto (in the case of the nut 102) the threaded neck 90. Consequently, the nut 102 can be tightened to clamp the dashboard panel 82 between the housing head back face 94 and the nut 102, thereby mounting the USB housing 78 to the dashboard panel 82.

Referring further to FIGS. 2, 3 and 4, as described above, the laterally rotatable slide-away protective cover 86 is pivotally connected to the housing 78 such that the cover 86 can be bidirectionally laterally rotated in a clockwise and a counter-clockwise direction, relative to a front face 110 of a housing head 98 of the USB port housing 78, between the opened and closed positions. More particularly, the cover 86 is pivotally connected to the housing 78 such that the cover 86 can be laterally rotated in an Open direction, e.g., a clockwise direction, to rotationally slide the cover 86 across the front face 110 of the housing head 98 to rotate the cover 86 about a pivot pin 114 and expose the front face 110, thereby allowing access to the USB port(s) 74 disposed within the housing head 98 (see FIG. 4). Conversely, the cover 86 can be laterally rotated in a Close direction, e.g., a counter-clockwise direction, to slide the cover 86 over the housing head front face 110 to cover the front face 110 of the housing head 98 and protect the USB port(s) 74 from water, moisture, dirt and debris. As used herein, the term laterally rotated, i.e., lateral rotation of the cover 86, will be understood to mean rotation of the cover 86 about a longitudinal axis X such that the cover 86 bidirectionally rotates in a clockwise direction and a counter-clockwise direction in a plane that is coplanar to the housing head front face 110.

The cover 86 can be pivotally connected to the housing 78, e.g., to the housing head 98, via any suitable pivotal connection means. For example, in various embodiments, as exemplarily illustrated in FIG. 4, the cover can be pivotally connected to the housing head 98 via the pivot pin 114 that extends through pivot pin hole 118 in the protective cover 86 and is longitudinally disposed (e.g., along the axis X) and retained within a pin receptor 122 (best illustrated in FIG. 5) of the housing head 98. The pivot pin 114 can be retained within the pin hole 118 and the pin receptor 122 using any suitable retention device, such as a spring clip or spring washer (not shown). In various embodiments, the cover 86 can be pivotally biased to the Closed position via a biasing spring 126, or other suitable biasing device or mechanism. Importantly, when in the Open position, due to the lateral rotation of the cover 86 between the Open and Closed positions, the biasing spring 126 and cover 86 will not place any undesirable force on a user device USB cable connector mated with the USB port 74, as described below, and therefore will not cause damage to the user device USB connector or the USB port 74.

Figure 5:
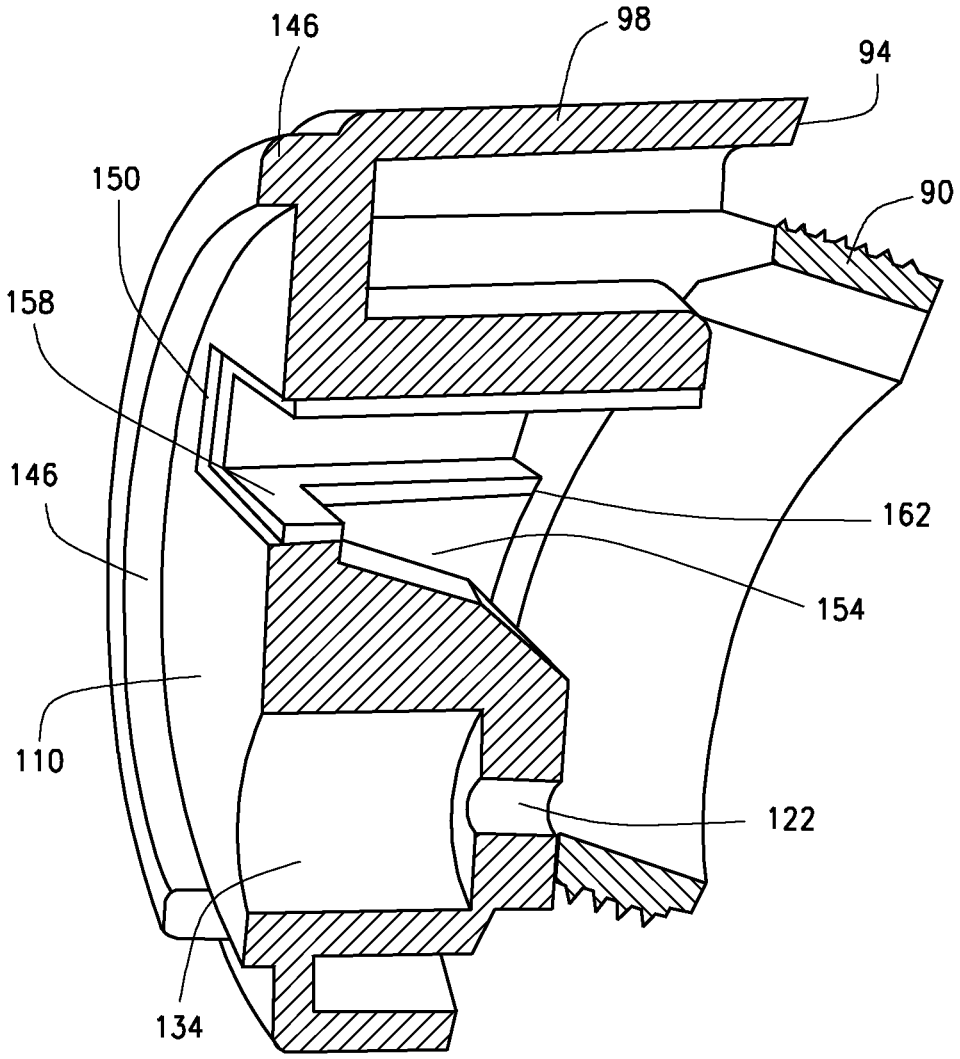
FIG. 5 is a cross-sectional view of the housing of the USB port module shown in FIGS. 1 through 4 illustrating a water drainage channel of the USB port module, in accordance with various embodiments of the present disclosure.
Figure 6A:
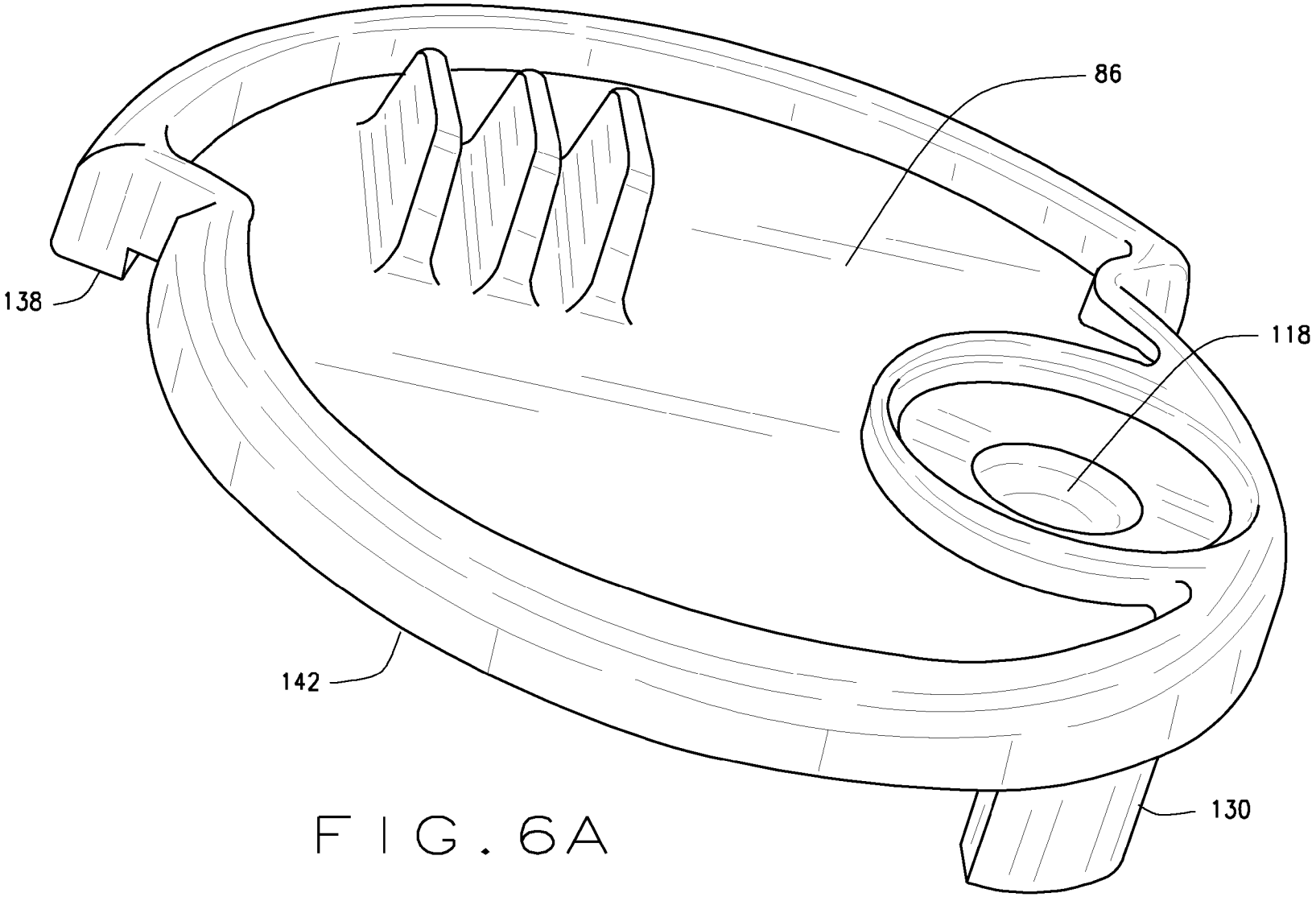
FIG. 6A is an isometric view of a top side of the laterally rotatable slide-away protective cover of the USB port module shown in FIGS. 1, 2 and 3, in accordance with various embodiments of the present disclosure.
Figure 6B:
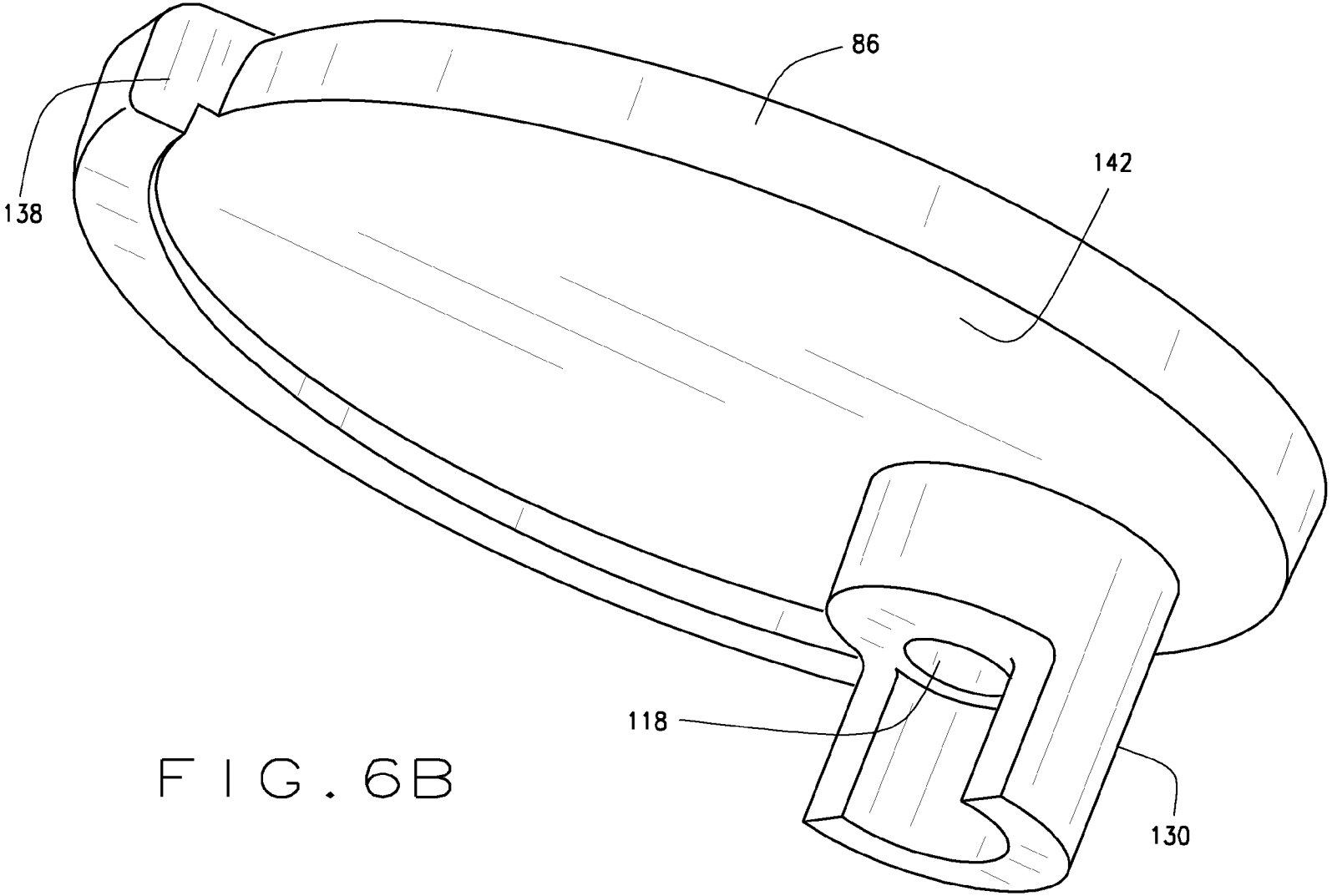
FIG. 6B is an isometric view of a bottom side of the laterally rotatable slide-away protective cover of the USB port module shown in FIG. 6A, in accordance with various embodiments of the present disclosure.

Referring now to FIGS. 5, 6A and 6B, in various embodiments, the cover 86 can include a cylindrical centering stem 130 and the housing head 98 can include a stem receiving well 134. The center stem 130 is sized and shaped to be tactually and rotationally received within the well 130 and is structured and operable to stabilize (e.g., prevent wobbling), align and control rotation of the cover 86 between the Open and Closed positions. In various embodiments, the cover 86 includes a first water barrier lip 138 formed around a portion of the perimeter thereof, and longitudinally extending (e.g., extending in a direction substantially parallel to the axis X) from an underside 142 of the cover 86. The first water barrier lip 138 is structured and operable to provide a barrier to water, moisture dirt and debris penetrating and accumulating between the cover underside 142 and the housing head face front 110 when the cover is in the closed position. In such embodiments, the housing head 98 includes a second water barrier lip 146 formed around a portion of the perimeter thereof, and longitudinally extending (e.g., extending in a direction substantially parallel to the axis X) from, the housing head front face 110. Like the first water barrier lip 138, the second water barrier lip 138 is structured and operable to provide a barrier to water, moisture, dirt and debris penetrating and accumulating between the cover underside 142 and the housing head face front 110 when the cover is in the closed position. More specifically, when the cover 86 is in the Closed position, the first and second water barrier lips 138 and 146 contact each other, e.g., meet, to form a barrier around the entire circumference of the housing head front face 110, thereby providing a circumferential barrier to water, moisture, dirt and debris penetrating and accumulating between the cover underside 142 and the housing head face front 110 when the cover is in the closed position.

Referring now to FIGS. 4 and 5, the housing head 98 includes at least one USB port receptacle 150 that is structured and operable to receive and retain the USB port(s) 74 disposed on the distal end of the USB power and communication cable 64 of the USB harness 66 (shown in FIGS. 2 and 3). The USB port(s) 74 and receptacle(s) 150 are structured and operable to interlocking mate with each other via any suitable connection means, e.g., the USB port(s) can snap-fit into the USB port receptacle(s) 150. Accordingly, when the USB system 14 is installed in the vehicle 10, and the slide-away protective cover 86 is laterally pivoted to the Open position, the USB port(s) 74 are exposed and accessible to receive and mate with a connector, e.g., a male connector, of a standard USB device cable (not shown) to electrically and communicatively connect the user device to the power converter and communication circuit 38, whereby the user device can receive charging power and/or send/receive communication signals (e.g., data input/output signals) to/from the power converter and communication circuit 38.

Referring now to FIG. 5, in various embodiments, the housing head 98 can include at least one water drainage channel 154 that is/are structured and operable to divert water and moisture away from the USB port(s) 74. Particularly, the drainage channel(s) 154 is/are structured and operable to divert any water/moisture that may enter and penetrate the USB port receptacles 150 away from the respective USB port(s) 74. By diverting the water/moisture away from the respective USB port(s) 74, the risk of: 1) electrical shorts between the pins of the USB port(s) 74 and the connector of the user device USB cable that could potentially damage the user device and/or the USB port(s) 74; and/or 2) electrolysis/corrosion of the USB port pins, is reduced or prevented. In various implementations, the drainage channel(s) 154 is/are formed internally in the housing head 98 beneath each USB port receptacle 150 such that any water/moisture entering the respective USB port receptacle 150 will be diverted away from the respective USB port receptacle 150, and user device USB cable connector, via gravity.

Moreover, that the drainage channel(s) 154 are structured and operable to divert any water/moisture entering the respective USB port receptacle 150 regardless of the orientation of the USB port receptacle(s) 150. That is, although the USB port receptacle(s) 150 are exemplarily illustrated as being formed within the housing 78 in a horizontal orientation, the USB port receptacle(s) 150 can be formed within the housing 78 in a vertical orientation and the drainage channel(s) 154 would similarly divert any water/moisture entering the USB port receptacle(s) 150. Furthermore, the drainage channel(s) 154 are structured and operable such that if the housing 78 were rotated 90° and mounted to the dashboard front panel 82, such that the USB port receptacle (s) was/were vertically oriented, the drainage channel(s) 154 would similarly divert any water/moisture entering the USB port receptacle(s) 150. Still further, it is envisioned that the housing head 98 can include one or more other water drainage channels that can be exteriorly formed, e.g., have at least a portion of the drainage channel terminate at, or be formed within, the front face 110 of the housing head 98.

Additionally, in various embodiments, as part of the connection means to connect the USB port(s) 74 within the USB port receptacle(s) 150, the housing 78 can further include a metal or plastic connection sleeve 158 that is disposed within, e.g., molded within, each USB port receptacle 150. It is envisioned that in such embodiments, the sleeve(s) 158 can comprise a drainage channel access opening 162 formed in a bottom side of the sleeve(s) 158.

Figure 8B:
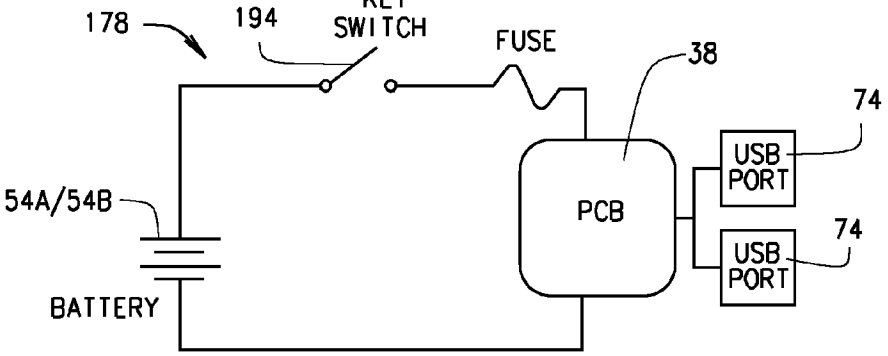
FIGS. 8A and 8B are block circuit diagrams of the electrical and communication connections of the USB connection system shown in FIG. 1 and a regulated power supply circuit thereof, in accordance with various embodiments of the present disclosure.
Figure 8A:
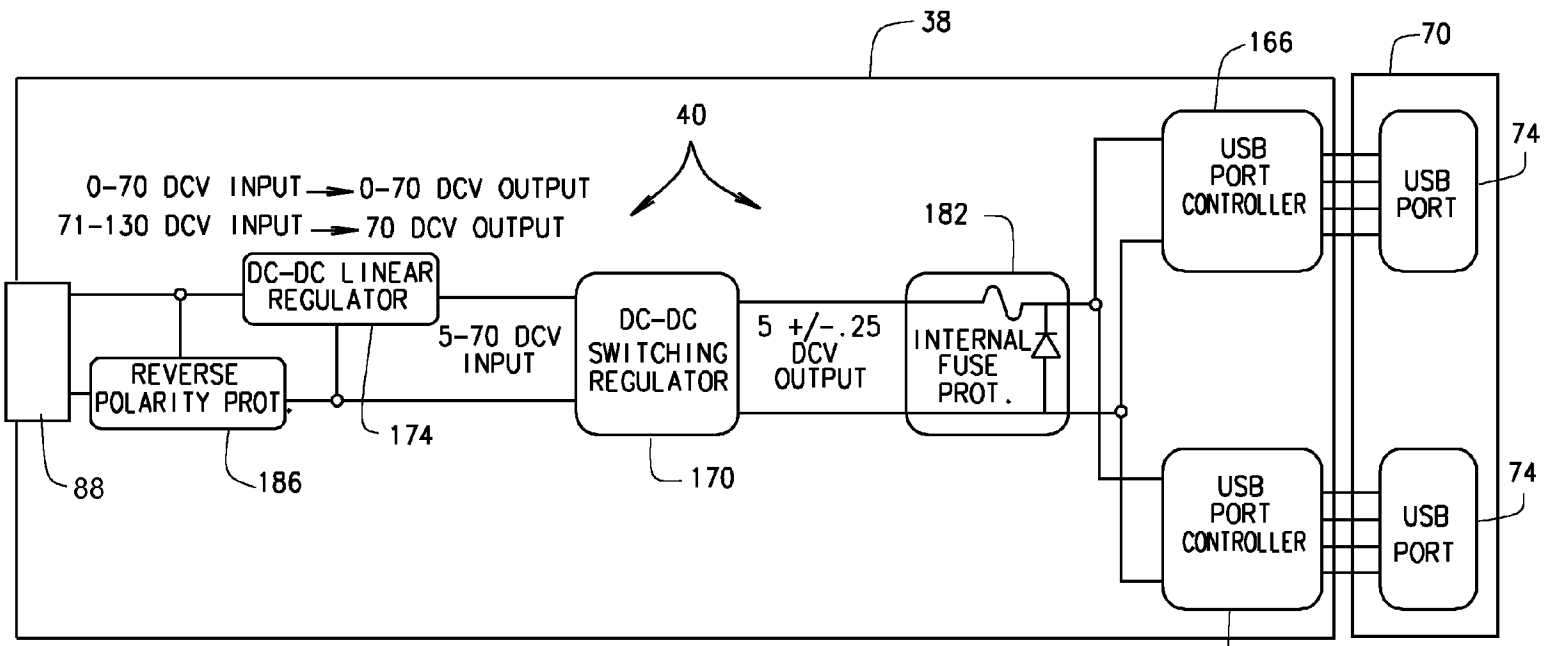

Referring now to FIGS. 7, 8A and 8B, FIG. 8A provides an exemplary illustration of the regulated USB power supply circuit 40 disposed on the encapsulated power converter and communication circuit 38, and FIG. 8B provides an exemplary illustration of a power supply circuit for providing power from the vehicle onboard power supply to the power converter and communication circuit 38 and regulated USB power supply circuit 40. In various embodiments, the regulated USB power supply circuit 40 generally comprises the input power supply connector 88, e.g., an 8 pin connector, for connection to the input power source 54A/54B, via the power supply and vehicle communication harness 50. As described above, the circuit 40 is structured and operable to accept/receive 5 to 100 volts input and output 5 volts, e.g., 5 volts at 1 amp, to each USB port 74. In various embodiments, the output current is limited to 1 Amp per USB port 74 in order to limit the power and heat of the electronic components of the circuit 40. This is sufficient to power and charge most known USB connectable user devices.

In various implementations, the power supply connector 88 includes a power, a ground, and a signal line for each of USB port 74. The voltage on the signal line(s) is set to a specific value, e.g., 5 volts, in order to signal the user device that charging and/or communication is available. A USB port controller 166 (e.g., a Texas Instruments TPS2511) is provided for each USB port 74 to set the signal levels correctly so that all common cell phones, tablets and other user devices can be charged. In order to handle the wide nominal voltage range as well as transients of up to 100 volts, in various embodiments, the circuit 40 incorporates two stages, wherein a 5 volt switching regulator 170 is preceded by a linear regulator 174. This combination allows USB system 14 to operate on both gasoline vehicles with a 12 volt battery and electric vehicles with up to 48 volt battery packs.

In various implementations, the power converter and communication circuit 38, i.e., the circuit 40, can include overvoltage protection, thermal protection, and fault tolerance circuitry. Additionally, in various embodiments, the circuit 40 can include reverse polarity protection circuitry 186 that prevents damage when the input is connected backwards. Furthermore, a common failure mode of non-isolated power supplies is a short circuited power transistor, which conducts input voltage directly to the output, and can damage or destroy any connected user device. To prevent user devices from being damaged from such short circuits internal fuse protector circuitry 182 is incorporated in to the circuit 40 that includes a fuse, e.g., a 10 Amp fuse, and an avalanche diode. If voltage at the output to the power converter and communication circuit 38 exceeds 7.5 volts then a transient voltage suppressor, such as, the avalanche diode, conducts enough current to blow the fuse 182 in the path of current flow, thereby rendering the power converter and communication circuit 38 and circuit 40 permanently inoperable. However, any connected user device will not be damaged. Additionally, in various implementations the power to the power converter and communication circuit 38 and circuit 40, e.g., power from the battery/battery pack 54A/54B of vehicle 10, is supplied through a vehicle key switch 194. On gasoline cars this is typically 12 volts DC. On electric cars it is typically 48 volts DC. Having the power supply connected to the power converter and communication circuit 38 and circuit 40 through the vehicle key switch 194 prevents drainage of the vehicle battery/battery pack 54A/54B when the key switch is off and a user device is connected to the USB port 74.

As described above, the water resistant USB system 14 is suitable for implementation in any open cab utility, outdoor and/or off-road recreational vehicle, such as golf cars, turf-care vehicles, small maintenance, shuttle or cargo vehicles, ATVs, UTVs, motorcycles, etc. And furthermore is suitable for implementation into any such vehicle regardless of whether the vehicle is gas powered or electric powered, and regardless of the onboard voltage of such the respective vehicle. That is, the water resistant USB system 14 is suitable for use with gas and electric vehicles, and can be connected to onboard power supplies having a wide range voltage output, for example, onboard supply voltages ranging from 5 volts to 100 volts.

The description herein is merely exemplary in nature and, thus, variations that do not depart from the gist of that which is described are intended to be within the scope of the teachings. Such variations are not to be regarded as a departure from the spirit and scope of the teachings.

What is claimed is:

1. A water resistant universal serial bus (USB) connector assembly for a vehicle, said assembly comprising:

a USB connection harness, at least a portion of the USB connection harness internally disposable within a dashboard of a vehicle, the USB connection harness including at least one USB port disposed at a first end and at least one harness connector disposed at an opposing second end; and a USB port module disposable within the dashboard of the vehicle and connectable to the USB connection harness via the at least one USB port, the USB port module comprising:

a housing;

at least one USB port receptacle internally disposed within the housing, each USB port receptacle structured and operable to receive a respective USB port through a back face of the housing, thereby internally connecting the USB connection harness to the USB port module such that a user electronic device can be connected to the each respective USB port through a front face of the module housing;

at least one water drainage channel formed internally within the housing and internally connected to the at least one USB port receptacle, the at least one water drainage channel extending inward toward a back face of the housing, and structured and operable to drain water that has entered the at least one USB port receptacle away from each respective USB port to an interior space of the vehicle dashboard; and a rotatable slide-away protective cover pivotally connected to the module housing such that the protective cover can be bidirectionally rotated, relative to the front face of the module housing, between an opened and a closed position.

2. The assembly of claim 1, wherein:

the slide-away protective cover comprises a first water barrier lip formed around a portion of a perimeter thereof, and extending from an underside thereof; and the USB port module housing comprises a second water barrier lip formed around a portion of a perimeter of the front face thereof, and extending from the front face, wherein the first and second barrier lips are structured and operable to meet when the slide-away protective cover is in the closed position to thereby form a circumferential barrier around the front face of the module housing.

3. A water resistant universal serial bus (USB) system for a vehicle, said system comprising:

a USB connector assembly, the USB connector assembly comprising:

a USB connection harness, at least a portion of the USB connection harness internally disposable within a dashboard of a vehicle, the USB connection harness including at least one USB port disposed at a first end and at least one harness connector disposed at an opposing second end; and a USB port module disposable within the dashboard of the vehicle and connectable to each USB connection harness via the at least one USB port, the USB port module comprising:

a housing;

at least one USB port receptacle internally disposed within the housing, each USB port receptacle structured and operable to receive a respective USB port through a back face of the housing, thereby internally connecting the USB connection harness to the USB port module such that a user electronic device can be connected to the each respective USB port through a front face of the module housing;

at least one water drainage channel formed internally within the housing and internally connected to the at least one USB port receptacle, the at least one water drainage channel extending inward toward a back face of the housing, the at least one water drainage channel structured and operable to drain water that has entered the at least one USB port receptacle away from each respective USB port to an interior space of the vehicle dashboard; and a rotatable slide-away protective cover pivotally connected to the module housing such that the protective cover can be bidirectionally rotated, relative to the front face of the module housing, between an opened and a closed position; and a water protected circuit board assembly disposable in the vehicle at a location remote from the USB port module, the circuit board assembly electrically and communicatively connectable to the USB connector assembly and electrically connectable to an onboard power source of the vehicle.

4. The system of claim 3, wherein:

the slide-away protective cover comprises a first water barrier lip formed around a portion of a perimeter thereof, and extending from an underside thereof; and the USB port module housing comprises a second water barrier lip formed around a portion of a perimeter of the front face thereof, and extending from the front face, wherein the first and second barrier lips are structured and operable to meet when the slide-away protective cover is in the closed position to thereby form a circumferential barrier around the front face of the module housing.

5. The system of claim 3, wherein the circuit board assembly comprises:

a power converter and communication circuit electrically connectable to an onboard power supply of the vehicle;

a USB power supply and communication harness connected to the power converter and communication circuit at a first end and including at least one circuit board connector disposed at an opposing second end, each circuit board connector connectable to a respective harness connector to electrically and communicatively connect each USB port to the power converter and communication circuit.

6. The system of claim 5, wherein the power converter and communication circuit is encapsulated within at least one of a water protective housing and a water protective coating.

7. The system of claim 5, wherein the power converter and communication circuit comprises a regulated power supply circuit structured and operable to receive a range of input voltages and output a regulated voltage to each USB port that can be utilized by the user device when the user device is connected to one of the at least one USB port.

8. The system of claim 7, wherein the range of input voltages comprises 5 volts to 100 volts.

9. A vehicle, said vehicle comprising:

a water resistant universal serial bus (USB) system, the system comprising:

a USB connector assembly, the USB connector assembly comprising:

a USB connection harness, at least a portion of the USB connection harness internally disposable within a dashboard of a vehicle, the USB connection harness including at least one USB port disposed at a first end and at least one harness connector disposed at an opposing second end; and a USB port module disposable within the dashboard of the vehicle and connectable to each USB connection harness via the at least one USB port, the USB port module comprising:

a housing;

at least one USB port receptacle disposed within the housing, each USB port receptacle structured and operable to receive a respective USB port through a back face of the housing, thereby internally connecting the USB connection harness to the USB port module such that a user electronic device can be connected to the each respective USB port through a front face of the module housing;

at least one water drainage channel formed internally within the housing and internally connected to the at least one USB port receptacle, the at least one water drainage channel extending inward toward a back face of the housing, the at least one water drainage channel structured and operable to drain water that has entered the at least one USB port receptacle away from each respective USB port to an interior space of the vehicle dashboard; and a rotatable slide-away protective cover pivotally connected to the module housing such that the protective cover can be bidirectionally rotated, relative to the front face of the module housing, between an opened and a closed position; and a water protected circuit board assembly disposable in the vehicle at a location remote from the USB port module, the circuit board assembly electrically and communicatively connectable to the USB connector assembly and electrically connectable to an onboard power source of the vehicle.

10. The vehicle of claim 9, wherein:

the slide-away protective cover comprises a first water barrier lip formed around a portion of a perimeter thereof, and extending from an underside thereof; and the USB port module housing comprises a second water barrier lip formed around a portion of a perimeter of the front face thereof, and extending from the front face, wherein the first and second barrier lips are structured and operable to meet when the slide-away protective cover is in the closed position to thereby form a circumferential barrier around the front face of the module housing.

11. The vehicle of claim 9, wherein the circuit board assembly comprises:

a power converter and communication circuit electrically connectable to an onboard power supply of the vehicle;

a USB power supply and communication harness connected to the power converter and communication circuit at a first end and including at least one circuit board connector disposed at an opposing second end, each circuit board connector connectable to a respective harness connector to electrically and communicatively connect each USB port to the power converter and communication circuit.

12. The vehicle of claim 11, wherein the power converter and communication circuit is encapsulated within at least one of a water protective housing and a water protective coating.

13. The vehicle of claim 11, wherein the power converter and communication circuit comprises a regulated power supply circuit structured and operable to receive a range of input voltages and output a regulated voltage to each USB port that can be utilized by the user device when the user device is connected to one of the at least one USB port.

14. The vehicle of claim 13, wherein the range of input voltages comprises 5 volts to 100 volts.

* * * * *